United States Patent [19]

Kusaba

[11] 4,393,679

[45] Jul. 19, 1983

[54] METHOD FOR PRODUCING BLANK FOR WIDE FLANGE BEAM

[75] Inventor: Yoshiaki Kusaba, Ibaraki, Japan

[73] Assignee: Sumitomo Metal Industries, Ltd., Osaka, Japan

[21] Appl. No.: 209,299

[22] Filed: Nov. 21, 1980

[30] Foreign Application Priority Data

Dec. 29, 1979 [JP] Japan ..... 54-172089

[51] Int. Cl.[3] ..... B21B 1/08

[52] U.S. Cl. ..... 72/221; 72/366

[58] Field of Search ..... 72/221, 222, 234, 365, 72/366, 226, 228, 229, 235

[56] References Cited

FOREIGN PATENT DOCUMENTS

| | | | |
|---|---|---|---|
| 53-8308 | 3/1978 | Japan | 72/221 |
| 53-57168 | 5/1978 | Japan | 72/226 |
| 55-70402 | 5/1980 | Japan . | |

*Primary Examiner*—Francis S. Husar
*Assistant Examiner*—Jonathan L. Scherer
*Attorney, Agent, or Firm*—Wenderoth, Lind & Ponack

[57] ABSTRACT

A blank for a wide flange beam is produced by feeding a flat slab to a break-down mill in which a box caliber, one or more forming calibers and a sizing caliber are formed by a pair of rolls, and rolling the material in a former stage of the rolling process so that the rectangular ratio of the rolled material is substantially equal to the rectangular ratio of the slab.

3 Claims, 14 Drawing Figures

METHOD FOR PRODUCING BLANK FOR WIDE FLANGE BEAM

BACKGROUND OF THE INVENTION

The present invention relates to a method for producing a blank for a wide flange beam by use of a break-down mill of a shaped steel rolling line using a flat slab as a raw material element to be rolled.

In the production of a wide flange beam, a beam blank rolled by a blooming mill heretofore has been used as a raw material element to be rolled and has been reheated in a heating furnace and then rolled into the desired steel shaping in a shape steel plant. Recently, however, there has become widely employed a heat rolling operation in which a continuous-cast flat slab is used as the raw material element to be rolled and is heated in a heating furnace and then rolled into the desired wide flange beam in one operation step in the steel shaping plant.

In an ordinary steel shaping plant, a flat slab heated and soaked in a heating furnace to a suitable temperature of 1,200° C. or above is rough-rolled by a break-down mill into a beam blank and thereafter rolled by a rougher universal mill having an edging mill in a latter stage and by a finishing universal mill into a desired wide flange beam.

The ordinary break-down mill has a pair of rolls forming first, second and third box calibers having sequentially larger widths and a sizing caliber of a rough H shape. The flat slab is fed to the first and the second box calibers with the widthwise direction thereof maintained vertically, whereby the flat slab is edged in the widthwise direction (about twice for each caliber) so as to be widened in the portions corresponding to flanges into a dog-bone-shaped workpiece. Thereafter, the dog-bone-shaped workpiece if fed alternately to the sizing caliber to be rolled into a beam blank after about 15 passes so as to be fed to universal mills in the succeeding steps.

The beam blank produced in this way has, however, the following problems:

(1) Continuous edging of a flat slab using a box caliber results in an increased central thickness at the top and the bottom thereof coupled with a fish-tail-like closing form in the upper and the lower edges since the slab is elongated longitudinally in the upper and the lower edges while it is not elongated in the central area at the top and the bottom. If such workpiece is rolled by the sizing caliber, a fin will occur on the sides of the resultant beam blank at the top and, particularly, at the bottom thereof, and such fin will remain in the final product as a defect.

(2) The continuous edging of the flat slab gradually decreases the rectangular ratio (the term rectangular ratio used herein and in the appended claims is defined as plate width/plate thickness or web height/web thickness). That is, since the plate thickness (or web thickness) is constant, the rectangular ratio decreases at each pass and the reduction effect reaches the central portion of the workpiece to thereby reduce the dog-bone effect. Accordingly, it is difficult to produce a wide flange beam having a flange width larger than the slab thickness.

SUMMARY OF THE INVENTION

The object of the present invention is to provide a method for producing a blank for a wide flange beam of a large size in one heat without resulting in formation of fins at ends of the workpiece.

The method according to the present invention is characterized in that a box caliber, one or more forming calibers and a sizing caliber are formed by a pair of rolls of a break-down mill, a flat slab is used as a raw material element for rolling, and the rolling operation is divided into a former stage and a latte stage. In the former stage the raw material element is repeatedly edged by the box caliber with the widthwise direction of the blank maintained vertically and, thereafter, is repeatedly reduced mainly in the portion thereof corresponding to the web by the forming calibers into a dog-bone-shaped workpiece which is, in the latter stage, repeatedly edged to be reduced in the widthwise direction and web-rolled in the web-thickness direction by the box caliber and the sizing caliber, respectively, into a beam blank having a large flange width.

In a step during the former stage, the rectangular ratio of the workpiece after the web-rolling operation is maintained substantially equal to that of the raw material. The tolerance of the rectangular ratio is preferably ±10%. Further, the optimum range of the rectangular ratio is 3 to 6, since with a rectangular ratio less than 3 the dog-bone effect is not achieved and the workpiece becomes barrel-shaped in section, and with a rectangular ratio exceeding 6, on the other hand, buckling is caused. At least in one of a plurality of steps during the former stage, the rectangular ratio of the rolled workpiece must be equal to that of the initial raw material.

BRIEF DESCRIPTION OF THE DRAWINGS

The invention will be better understood from the following description taken in connection with the accompanying drawings in which.

DETAILED DESCRIPTION OF THE PREFERRED EMBODIMENTS

Figure 1:
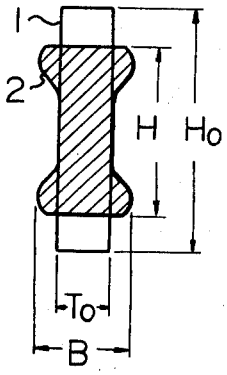
FIG. 1 is an overlapped cross-sectional view of a flat slab as the raw material for rolling and a beam blank for a wide flange beam showing the relative sizes of each of the slab and the blank.

Before describing the method according to the present invention, problems of the conventional method will be considered with respect to the case in which a flat slab 1 having, as shown in FIG. 1, thickness $T_o$ and width $H_o$ is used as the raw material which is rolled through the predetermined process into a blank 2 for a wide flange beam having, as shown in FIG. 1, a miximum thickness B and a width H.

Figure 2:
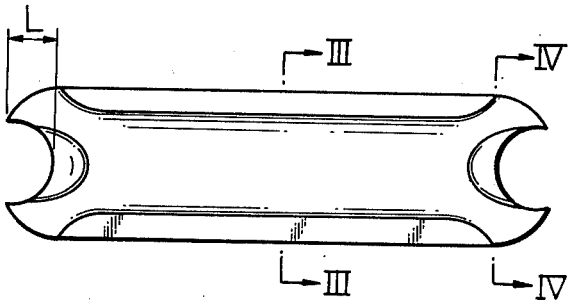
Fig. 2 PRIOR ART
FIG. 2 is a front elevation of a workpiece obtained by the conventional rolling process.
Figure 3:
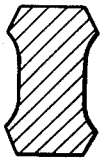
Fig. 3 PRIOR ART
FIG. 3 is a cross-sectional view taken along the line III—III of FIG. 2.
Figure 4:
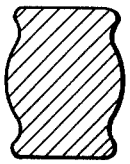
Fig. 4 PRIOR ART
FIG. 4 is a cross-sectional view taken along the line IV—IV of FIG. 2.
Figure 5:
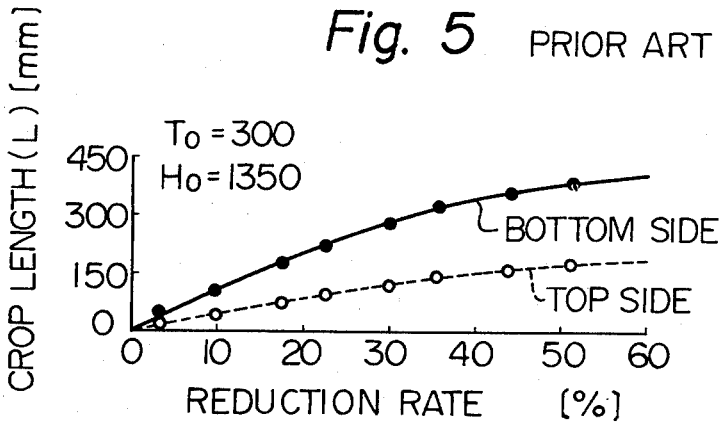
Fig. 5 PRIOR ART
FIG. 5 is a graph showing the relation between the reduction rate and the crop length of the workpiece obtained by the conventional rolling process.

After a continuous edging operation using a box caliber, a rolled workpiece has an increased central thickness at both the top and the bottom thereof and the upper and the lower edges thereof take the form of a fish-tail shape as shown in FIG. 2, since the workpiece is elongated longitudinally at the upper and the lower edges while it is not elongated in the central area at the top and the bottom thereof as shown in FIGS. 2 to 4. This tendency is shown graphically in FIG. 5.

Figure 6:
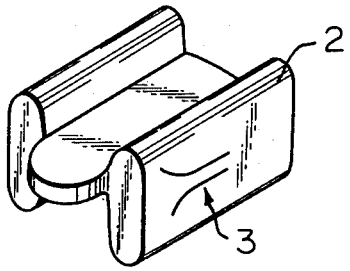
Fig. 6 PRIOR ART
FIG. 6 is a perspective view of a portion of a beam blank for a wide flange beam obtained by the conventional rolling process.

When such workpiece is rolled by the conventional sizing caliber, a fin 3 occurs, as shown in FIG. 6, on the sides of the resultant beam blank at the top and, particularly, at the bottom thereof, which will remain in the final product as a defect.

When the workpiece is continuously edged, the rectangular ratio thereof decreases gradually. Since the plate thickness (or web thickness) is constant, the rectangular ratio decreases at each pass and the reduction effect reaches the central portion of the workpiece to thereby reduce the dog-bone effect. That is, as the edging reduction rate $$\left(\frac{H_o - H}{H_o}\right)$$

increases (or as the rectangular ratio decreases), the rate of increase of the flange widening ratio ($B/T_o$) decreases. This tendency is shown graphically in FIG. 7. Accordingly, it is difficult to produce a wide flange beam having a flange width which is larger than the slab thickness in the conventional method.

The present invention contemplates solving the above-described problems of the conventional method by providing an improved method for producing beam blanks for various wide flange beams of a maximum length up to 900 mm and a maximum width up to 400 mm.

Figure 8:
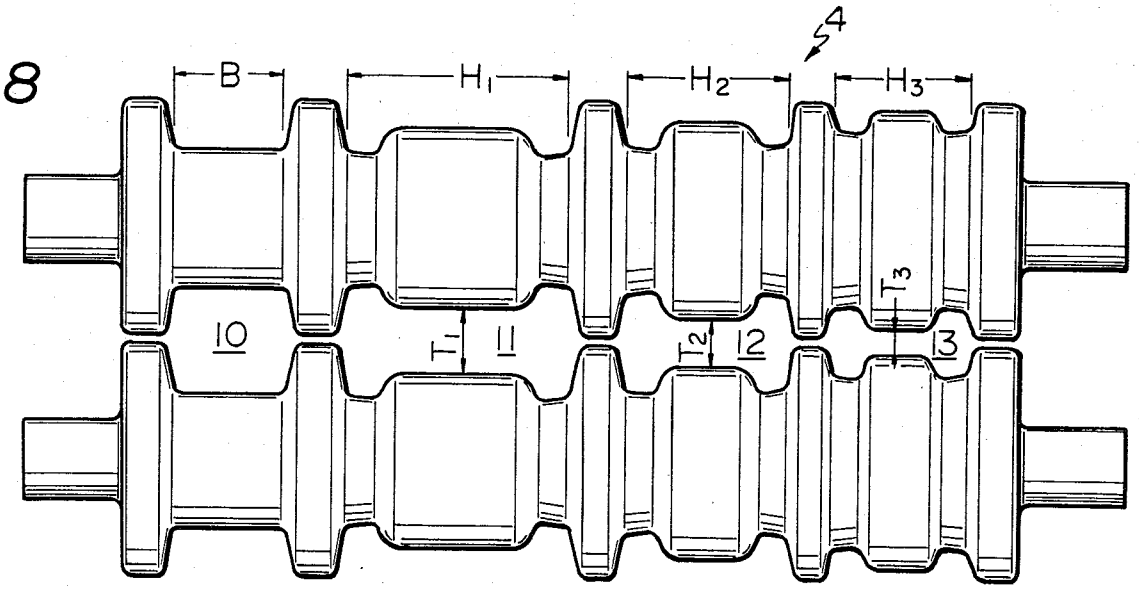
FIG. 8 is a front elevation of a pair of rolls of a break-down mill used in the method according to the present invention, showing the rolling calibers.

The roll of the break-down mill used in the method according to the present invention will now be described with reference to FIG. 8. As illustrated, in a pair of rolls 4 there are formed a box caliber 10, a first and a second forming calibers 11 and 12, respectively, and a sizing caliber 13, such last three calibers being sequentially smaller in size. In the drawings, reference character B denotes the width of the box caliber 10. Characters $H_1$, $H_2$, and $H_3$ denote the widths of the first and the second forming calibers 11 and 12 and the sizing caliber 13, respectively, which are sequentially smaller. Characters $T_1$, $T_2$, and $T_3$ denote the gap lengths corresponding to web thicknesses of the first and the second forming calibers 11 and 12, and the sizing caliber 13, respectively, which are sequentially smaller.

Figure 9C:
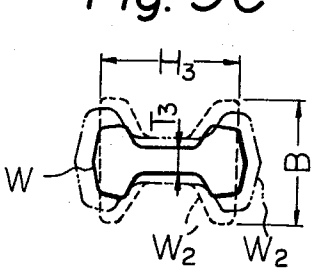
FIGS. 9A to 9C are cross-sectional views of the workpiece obtained by the method according to the present invention, showing variations in the cross-section of the workpiece through the respective rolling steps.
Figure 9B:
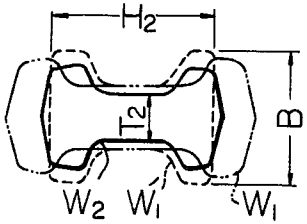
Figure 9A:
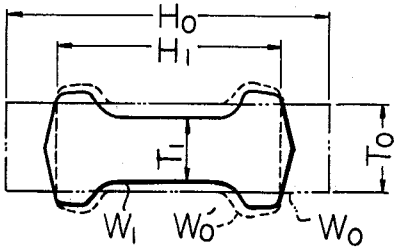

In the break-down mill having the above-described caliber arrangement, the rolling process is performed in the following steps:

(1) A flat slab $W_o$ having a width $H_o$ and a thickness $T_o$ as shown in FIG. 9A is edged by the box caliber 10 with the widthwise direction thereof maintained vertically, into a dog-bone-shaped workpiece $W_o'$ having a height $H_1$.

(2) The workpiece $W_o'$ is reduced in thickness by the first forming caliber 11 into a workpiece $W_1$ having a thickness $T_1$ of the portion corresponding to the web (see FIG. 9A). Here, the rectangular ratio ($H_1/T_1$) of the workpiece $W_1$ is substantially equal to the rectangular ratio ($H_o/T_o$) of the flat slab $W_o$. The rectangular ratio here is determined to be in the range of from 3 to 6, and the tolerance of the rectangular ratio ($H_1/T_1$) of the workpiece $W_1$ is determined to $\pm 10\%$ on the basis of the rectangular ratio ($H_o/T_o$) of the raw material.

(3) The workpiece $W_1$ is edged by the box caliber 10 into the workpiece $W_1'$ having a height $H_2$ in the portion corresponding to the web (see FIG. 9B). Here, the width of the portion corresponding to the flange of the workpiece $W_1'$ is widened to the width B of the box caliber 10.

(4) The workpiece $W_1'$ is rolled by the second forming caliber 12 into a workpiece $W_2$ (see FIG. 9B). Here, also, the rectangular ratio ($H_2/T_2$) of the workpiece $W_2$ is substantially equal to the rectangular ratio ($H_o/T_o$) of the raw material. The tolerance of the rectangular ratio is the same as in the step (2) above.

The foregoing steps (1) to (4) constitute the former stage of the rolling process of the method according to the present invention and the following steps (5) and (6) constitute the latter stage thereof.

(5) The workpiece $W_2$ is edged by the box caliber 10 into a workpiece $W_2'$ having a height of $H_3$ of the portion corresponding to the web (see FIG. 9C). Here, the width of the portion corresponding to the flanges of the workpiece $W_2'$ is widened again to the caliberr width B.

(6) Then, the workpiece $W_2'$ is rolled by the sizing caliber 13 into a beam blank W of the desired shape having a web thickness $T_3$ and a web height $H_3$ (see FIG. 9C). In this final sizing caliber 13, the rectangular ratio $H_3/T_3$ is established to be larger than the rectangular ratio ($H_o/T_o$) of the raw material.

As described above, the workpiece $W_1$ and $W_2$ are so rolled as to have the rectangular ratios which are substantially equal to that of the flat slab as the raw material. Alternatively, the edged workpiece $W_o'$ and $W_1'$ may be reduced in the portions corresponding to the webs so that the rectangular ratios thereof approach that of the flat slab as the raw material.

These workpieces are rolled so as to have the rectangular ratios substantially equal to that of the initial flat slab for the reasons stated below.

Figure 7:
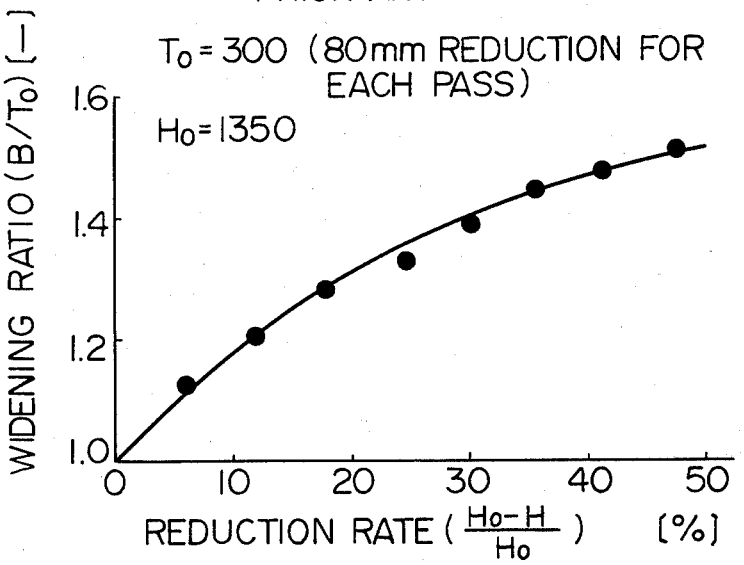
Fig. 7 PRIOR ART
FIG. 7 is a graph showing the relation between the reduction rate and the widening ratio of the workpiece obtained by the conventional rolling process.
Figure 10:
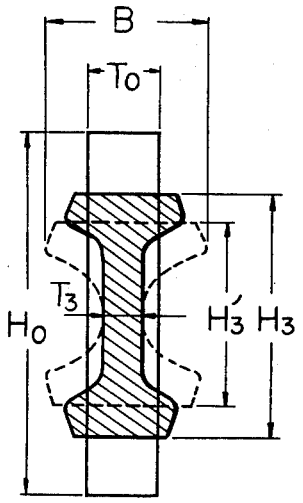
FIG. 10 is a cross-sectional view similar to FIG. 1, showing the sizes of portions of the workpiece through the respective rolling steps.
Figure 11:
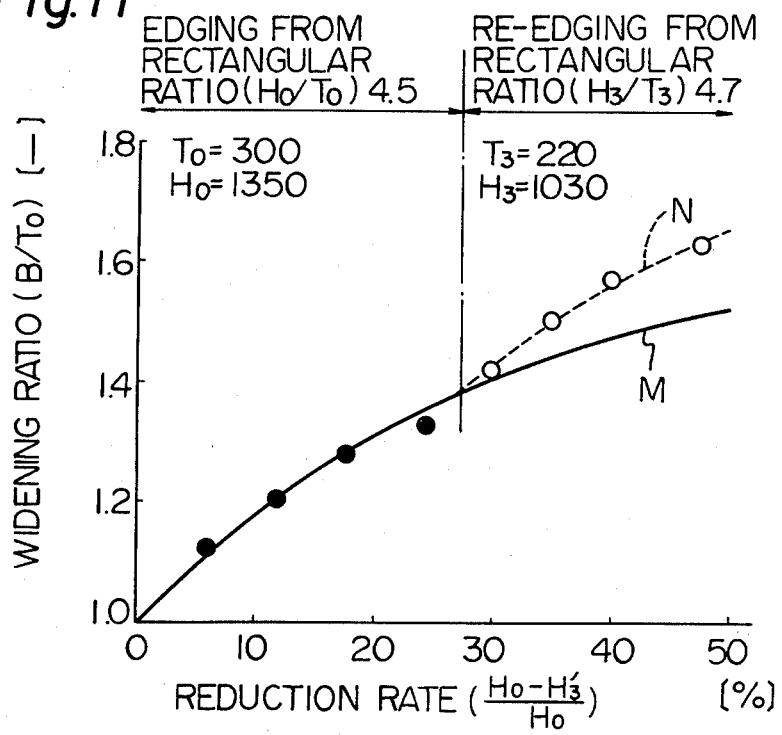
FIG. 11 is a graph showing the relation between the reduction rate and the widening ratio of the workpiece obtained by the method according to the present invention.

(1) The dog-bone effect in each edging pass is made substantially equal to that in the initial edging pass is and maintained at that level so as not to decrease. This will be described in more detail with reference to the drawings. In the rolling of the flat slab as the raw material and the workpieces of the sizes shown in FIG. 10, when the materials of the webs are reduced by the calibers at a reduction rate $$\left(\frac{H_o - H'_3}{H_o}\right)$$

of 30% as shown in FIG. 11 to enlarge the rectangular ratio thereof and then reduced to 60%, the widening ratio is not increased substantially beyond a reduction ratio of 40% or above, as will be clear from curve M of FIG. 7. In contrast to this, in the method according to the present invention, the widening ratio increases also at a reduction rate of 30% or above substantially at the same gradient as at a reduction ratio of 30% and below, as shown by curve N of FIG. 11.

(2) When the rectangular ratio of th dog-bone-shaped workpiece of each edging pass is made extremely larger than that of the raw material, buckling is caused in the web during the edging operation to thereby exceedingly decrease the dog-bone effect.

Figure 12:
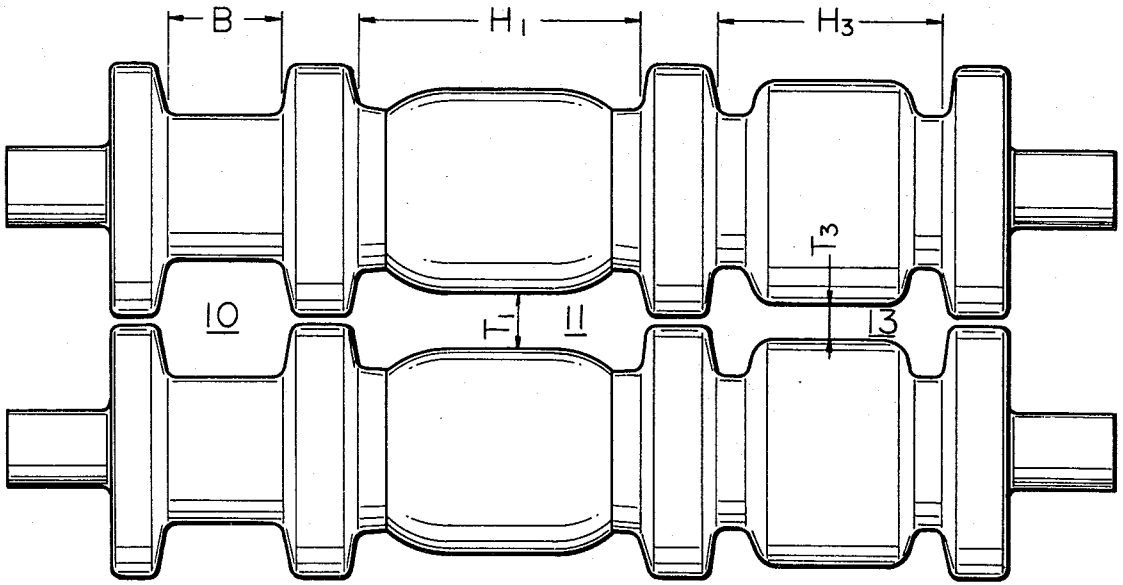
FIG. 12 is a front elevation of a pair of rolls of the break-down mill used in an embodiment of the present invention.

A specific example of the practice of the method according to the present invention will now be described in detail with reference to the case in which the beam blank W, as shown in FIG. 9C, for a wide flange beam of the nominal size 600×300 was formed from raw material which was the flat slab $W_o$, as shown in FIG. 9A, having the width ($H_o$) of 1400 mm, the thickness ($T_o$) of 300 mm and the rectangular ratio ($H_o/T_o$) of 4.67, using a pair of rolls forming only three calibers because of the limited space assigned therefor, namely a box caliber 10 (B=410 mm), a forming caliber 11 ($H_1$=1050 mm) and a sizing caliber 13 ($H_3$=850 mm) as shown in FIG. 12.

In the former stage of the method according to the present invention using the above-described construction:

(1) The flat slab $W_o$ was rolled by the box caliber 10 in five passes into the workpiece $W_o'$ having the height $H_1$ of 1050 mm (see FIG. 9A).

(2) The workpiece $W_o'$ having the thickness of 300 mm in the portion corresponding to the web was reduced by the forming caliber 11 in two passes into the dog-bone-shaped workpiece $W_1$ having the thickness $T_1$ of 220 mm in the portion corresponding to the web and a rectangular ratio of 4.77 (see FIG. 9A).

Succeedingly, in the latter stage:

(3) The workpiece $W_1$ was rolled by the box caliber 10 in three passes into the workpiece $W_1'$ having the height $H_2$ of 850 mm and the width B of 410 mm in the portions corresponding to the flanges (see FIG. 9B).

(4) The workpiece $W_1'$ was reduced by the sizing caliber 13 in five passes into the beam blank W having the web thickness $T_3$ of 80 mm, the web depth $H_3$ of 850 mm and the rectangular ratio of 10.63 (see FIG. 9C).

Several practical examples of the method according to the present invention are shown in Table 1, in which the above-described example is included as Example No. II.

TABLE 1

| Ex. No. | Size of Raw Material (mm) $H_0 \times T_0$ | $H_0/T_0$ | B (mm) | Former Stage: Workpiece $W_1$ (mm) $H_1 \times T_1$ | $H_1/T_1$ | Former Stage: Workpiece $W_2$ (mm) $H_2 \times T_2$ | $H_2/T_2$ | Latter Stage: Beam Blank W (mm) $H_3 \times T_3$ | $H_3/T_3$ | Product Nominal Size of Wide Flange Beam (mm) |
|---|---|---|---|---|---|---|---|---|---|---|
| I | 1550 × 300 | 5.17 | 410 | 1150 × 220 | 5.23 | | | 950 × 80 | 11.9 | H700 × 300 |
| II | 1400 × 300 | 4.67 | 410 | 1050 × 220 | 4.77 | | | 850 × 80 | 10.6 | H600 × 300 |
| III | 1300 × 300 | 4.33 | 410 | 1000 × 230 | 4.34 | 800 × 180 | 4.44 | 600 × 80 | 7.5 | H350 × 350 |
| IV | 1650 × 300 | 5.50 | 420 | 1350 × 230 | 5.90 | | | 1100 × 80 | 13.8 | H900 × 300 |
| V | 1350 × 300 | 4.50 | 440 | 1000 × 210 | 4.80 | | | 740 × 80 | 9.3 | H400 × 400 |

In the method according to the present invention, as described hereinabove, during the process in which the raw material is edged by the box caliber with the widthwise direction thereof maintained vertically and then repeatedly is reduced mainly in the portion corresponding to the web by the forming calibers, the cross section of the workpiece is reduced, with the rectangular ratio of the workpiece after web reduction being maintained substantially equal to that of the raw material. Accordingly, the present invention provides the advantages such that the crop shape of the beam blank at the top and the bottom is satisfactory and the fins 3 are prevented from occurring in the product. The present invention provides further advantages in that the dog-bone effect during the edging operation is large, a satisfactory flange width is easily secured, and a large size wide flange beam having a flange width of 300 mm or larger is rolled from a flat slab in one heat.

While there has been described and illustrated a present preferred example of practicing the method according to the present invention, it is to be distinctly understood that the invention is not limited thereto but may be otherwise variously practiced within the scope of the following claims.

What is claimed is:

1. A method for producing a blank for a wide flange beam, said method comprising:

forming a box caliber, at least one forming caliber and a sizing caliber by a pair of rolls of a break-down mill;

providing a flat slab as raw material with said flat slab having a rectangular ratio of width to thickness of from 3 to 6;

conducting a former stage of a rolling process by edging said raw material by said box caliber with the widthwise dimension of said material maintained vertically until the total reduction of said width is 30%, and then reducing said material, mainly in a web portion thereof, by said forming caliber, with the widthwise dimension of said web maintained horizontally, into a dog-bone-shaped workpiece having a rectangular ratio which substantially is equal to that of said raw material;

conducting a latter stage of said rolling process by edging said workpiece to reduce the width thereof by said box caliber with said web maintained vertically, and web-rolling said workpiece to reduce the thickness of said web by said sizing caliber with said web maintained horizontally, thereby forming said workpiece into a desired blank for a flange beam and providing said forming and sizing calibers to be sequentially smaller in width.

2. A method as claimed in claim 1, wherein said rectangular ratio of said workpiece in said former stage is equal to that of said raw material with a tolerance of ±10%.

3. A method as claimed in claim 1, wherein said web-rolling by said sizing caliber forms said blank with a rectangular ratio substantially larger than that of said raw material.

* * * * *